US005940882A

United States Patent [19]

Auguste

[11] Patent Number: 5,940,882

[45] Date of Patent: Aug. 24, 1999

[54] DETACHABLE COLLAR PROTECTOR DEVICE

[76] Inventor: Carl H. Auguste, 4917 N. Winthrop, Chicago, Ill. 60640

[21] Appl. No.: 09/135,325

[22] Filed: Aug. 17, 1998

[51] Int. Cl.[6] ..... A41D 27/16

[52] U.S. Cl. ..... 2/60; 2/129

[58] Field of Search ..... 2/60, 59, 63, 129, 2/135, 136, 137, 127, 53

[56] References Cited

U.S. PATENT DOCUMENTS

| | | | |
|---|---|---|---|
| 2,182,582 | 12/1939 | Cohen | 2/60 |
| 2,514,646 | 7/1950 | Johnson | 2/60 |
| 2,633,576 | 4/1953 | Powers et al. | 2/60 |
| 2,634,420 | 4/1953 | Jackson | 2/60 |
| 4,651,347 | 3/1987 | Brown | 2/60 |
| 4,653,119 | 3/1987 | Kaiser | 2/60 |
| 4,953,232 | 9/1990 | Gaines et al. | 2/60 |
| 4,980,927 | 1/1991 | Wawiluk et al. | 2/60 |
| 5,711,030 | 1/1998 | Anderson et al. | 2/60 |

*Primary Examiner*—Diana L. Oleksa
*Assistant Examiner*—Katherine Moran
*Attorney, Agent, or Firm*—Henderson & Sturm

[57] ABSTRACT

A detachable protector device 10 for the interior surface of the neck 101 of a shirt wherein the device 10 includes a permanent anchor component 11 fixedly secured to the interior surface of the neck 101 of a shirt 100, and a detachable protector component 12 releasably associated with the permanent anchor component 11. In one version of the invention, the opposite sides of the detachable protector component 12 are releasably associated with the permanent anchor component 11.

2 Claims, 1 Drawing Sheet

DETACHABLE COLLAR PROTECTOR DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of collar protector devices in general, and in particular to a collar protector having a permanently attached anchor position and a detachable protector portion.

2. Description of Related Art

As can be seen by reference to the following U.S. Pat. Nos. 2,633,576; 2,634,420; 4,953,232; and 4,980,927, the prior art is replete with myriad and diverse collar protector devices.

While all of the aforementioned prior art constructions are more than adequate for the basic purpose and function for which they have been specifically designed, they are uniformly deficient with respect to their failure to provide a simple, efficient, and practical collar protector device having a permanently mounted anchor component and a detachable protector component. The detachable protector component can be releasably secured to the anchor component and cleaned separately to reduce the wear and tear on the shirt caused by repetitive washing.

As most men are aware, the primary reason that a shirt must be laundered after a single use is due to the fact that the collar portion of the shirt is in constant rubbing contact with the back of a user's neck which transfers oils and dirt to the interior of the shirt collar.

As a consequence of the foregoing situation, there has existed a longstanding need for a new and improved collar protector device having a detachable protector component that can be removed and replaced with a clean detachable protector component to prolong the use of a given shirt between laundering, and the provision of such a construction is a stated objective of the present invention.

BRIEF SUMMARY OF THE INVENTION

Briefly stated, the collar protector device that forms the basis of the present invention comprises in general, an anchor component that is permanently affixed to the interior collar portion of a shirt and a detachable protector component that is releasably attached to the permanent anchor component.

As will be explained in greater detail further on in the specification, the permanent anchor component comprises an elongated strip backing material of the hook portion of a hook and loop fastener which is dimensioned to encircle the interior of the collar portion of a shirt and be permanently affixed thereto.

In addition, the detachable protector component comprises an elongated strip of the loop portion of a hook and loop fastener. One side of the loop portion is releasably attached to the hook portion and the other side of the loop portion is disposed in contact with the user's neck.

Furthermore, in one version of the preferred embodiment one side of the loop portion of the hook and loop fastener will be provided with a smooth cloth covering such as nylon, satin, silk, linen, cotton, or polyester to minimize the friction on the user's neck. In another version of the preferred embodiment, the loop portion will be exposed on both sides, so that the loop portion can be reversed on successive days to place a clean loop portion surface in contact with the user's neck each day of a two day period before the detachable component has to be laundered.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
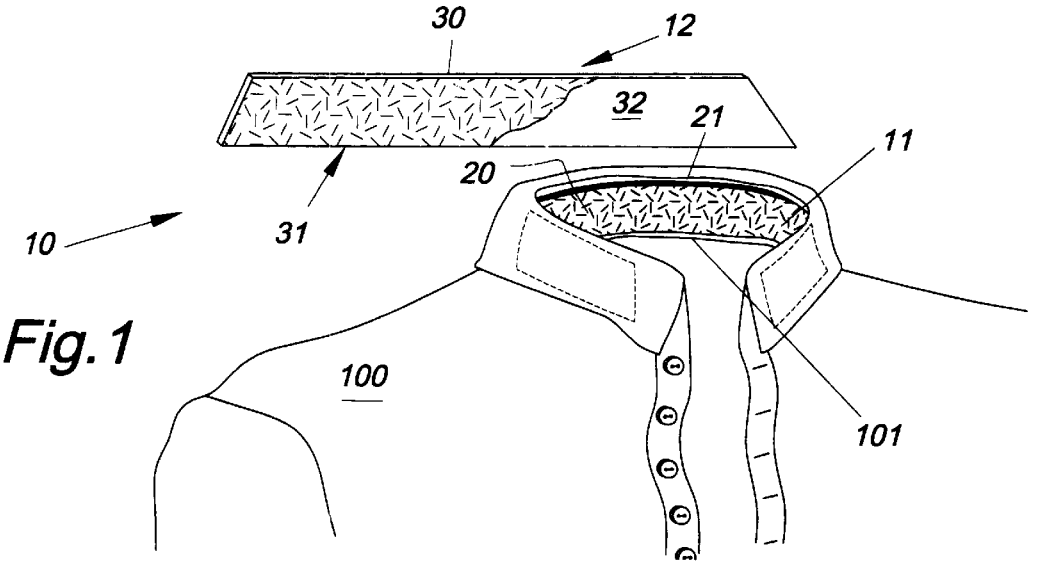
FIG. 1 is an exploded perspective view of the detachable collar protector device that forms the basis of the present invention.

As can be seen by reference to the drawings, and in particularly to FIG. 1, the detachable protector device that forms the basis of the present invention is designated generally by the reference number 10. The protector device 10 comprises a permanent anchor component 11 and a detachable protector component 12. These components will now be described in seriatim fashion.

Figure 2:
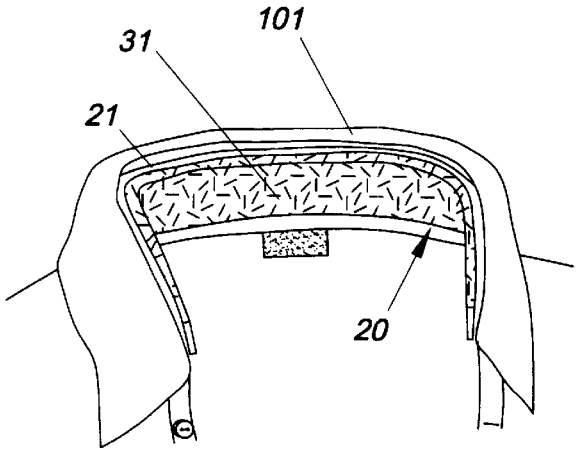
FIG. 2 is a perspective view of the two components of the device operatively deployed in their assembled relationship on the interior of a shirt collar.
Figure 3:
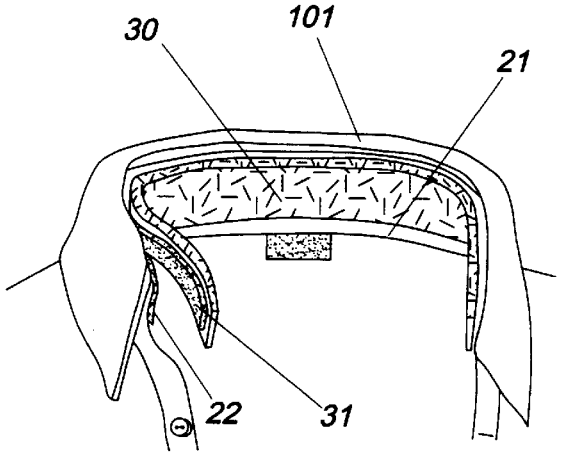
FIG. 3 is a perspective view of the two components of the device partially disassembled on the interior of the shirt collar.

As shown in FIGS. 1 through 3, the protector device 10 is designed specifically for use on the interior surface of the neck 101 of a shirt collar 100.

In addition, as shown in FIGS. 1 and 3, the permanent anchor component 11 comprises the hook portion 20 of a conventional hook and loop fastener. The hook portion 20 is formed on an elongated strip 21 of backing material 22 which is permanently affixed to the interior surface of the neck 101 of a shirt collar 100.

As can also be seen by reference to FIGS. 1 through 3, the detachable protector component 12 comprises the loop portion 30 of a conventional hook and loop fastener. The loop portion 30 is formed into an elongated strip 31 of loop material which is adapted to releasably engage the hook portion 20 in a well recognized fashion to provide a protector device 10 that will prevent the interior 101 of the shirt 100 coming into direct contact with the user's neck.

Furthermore, as was mentioned previously in the specification, the loop portion 30 alone may constitute the entire make up of the detachable protector component 10. The opposite sides of the loop portion 30 are employed on alternate days.

In the alternative as depicted in FIG. 1, one side of the loop portion 30 may be provided with a fabric covering 32 such as linen, silk, cotton, satin, polyester, nylon or the like to minimize the chaffing of the user's neck by virtue of the constant contact between the user's neck and the protector device.

In the first version of the preferred embodiment the double sided loop portion 30 can be used on two successive days until both sides of the loop portion 30 have become soiled by contact with the user's neck at which time a replacement loop portion 30 may be employed or the original loop portion is cleaned for reuse.

In either case, the use of replacement loop portions 30 can prolong the useful life of a shirt 100 between laundering, since the neck portion 101 of the shirt 100 is always maintained in a relatively pristine condition relative to the remainder of the shirt 100 until such time as the remainder of the shirt 100 becomes soiled through repeated usage.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A detachable collar protector device for the interior surface of the neck of a shirt wherein the protector device comprises:

an anchor component comprising the hook portion of a conventional hook and loop fastener wherein the hook portion is formed on an elongated strip of backing material which is permanently affixed to the interior surface of the neck of a shirt; and a detachable protector component comprising the loop portion of a conventional hook and loop fastener wherein the loop portion is formed into an elongated strip of material having two sides wherein the loop portion is exposed on both sides of said strip of material.

2. The protector device as in claim 1 wherein said permanent anchor component and said detachable protector component are sized, constructed and arranged for containment within said neck of said shirt so as to remain hidden from view when said shirt is worn.

* * * * *